United States Patent [19]

Leggett

[11] Patent Number: 4,687,055

[45] Date of Patent: Aug. 18, 1987

[54] WIRE-LINE CONTROLLED DOWN-HOLE SHUT-IN TOOL FOR WELLS

[76] Inventor: Henry H. Leggett, 38 Joo Koon Circle, Jurong, Singapore, 2262

[21] Appl. No.: 849,123

[22] Filed: Apr. 7, 1986

[51] Int. Cl.[4] ..... E21B 34/10

[52] U.S. Cl. ..... 166/72; 166/183; 166/324; 166/334

[58] Field of Search ..... 166/72, 73, 183, 184, 166/332, 334, 324, 238

[56] References Cited

U.S. PATENT DOCUMENTS

| | | | |
|---|---|---|---|
| 2,964,942 | 12/1960 | Reed | 73/155 |
| 3,078,923 | 2/1963 | Tausch | 166/72 |
| 3,860,066 | 1/1975 | Pearce | 166/72 |
| 4,031,955 | 6/1977 | Ledet | 166/183 |
| 4,105,279 | 8/1978 | Glotin et al. | 339/117 R |
| 4,325,431 | 4/1982 | Akkerman . | |
| 4,340,088 | 7/1982 | Geisow | 166/332 |
| 4,386,531 | 6/1983 | Heimgartner et al. | 73/756 |
| 4,407,363 | 10/1983 | Akkerman | 166/183 |
| 4,434,847 | 3/1984 | Vasquez et al. | 166/117.5 |
| 4,454,913 | 6/1984 | Guidry e al. | 166/117.5 |
| 4,483,397 | 11/1984 | Gray | 166/250 |
| 4,524,831 | 6/1985 | Pringle | 166/322 |
| 4,527,631 | 7/1985 | Vasquez | 166/117.5 |
| 4,557,333 | 12/1985 | Beck | 166/332 |

OTHER PUBLICATIONS

Flopetrol Johnston, "MUST"-Universal DST Real Time Surface Pressure Read Out.

*Primary Examiner*—Stephen J. Novosad
*Assistant Examiner*—Terry Lee Melius

[57] ABSTRACT

A wire-line controlled down-hole shut-in tool for wells incorporates a mandrel adapted for connection in a tubing string. A shut-in valve mechanism within the mandrel is opened and maintained in its open position by a sectioned flow tube assembly and is permitted to close upon linear retraction of the flow tube thus causing temporary shut-in of the well such as for purposes of inspecting formation pressure. The shut-in tool mechanism incorporates a pressure equalization system which is controlled by downward linear movement of the flow tube assembly for establishing a pressure balanced condition at the shut-in valve to permit opening of the valve without excessive force. Pressure balancing with the shut-in valve in its closed position is achieved by control of pressure equalization valves in response to actuation of a lost-motion connection between upper and lower sections of the elongated flow tube assembly.

17 Claims, 5 Drawing Figures

FIG. 1A
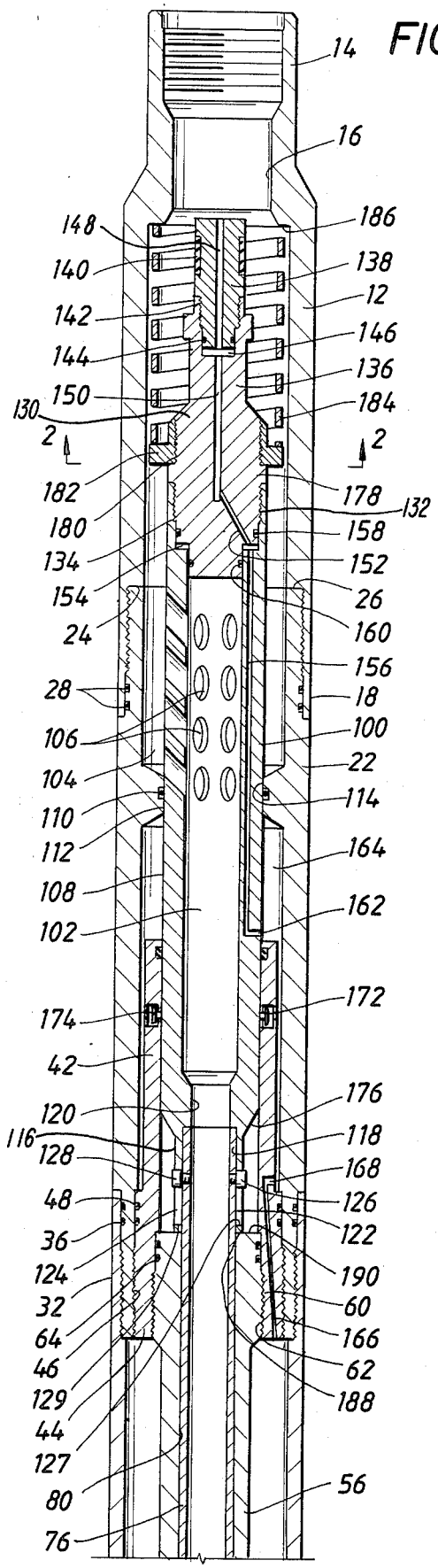
FIG. 1B
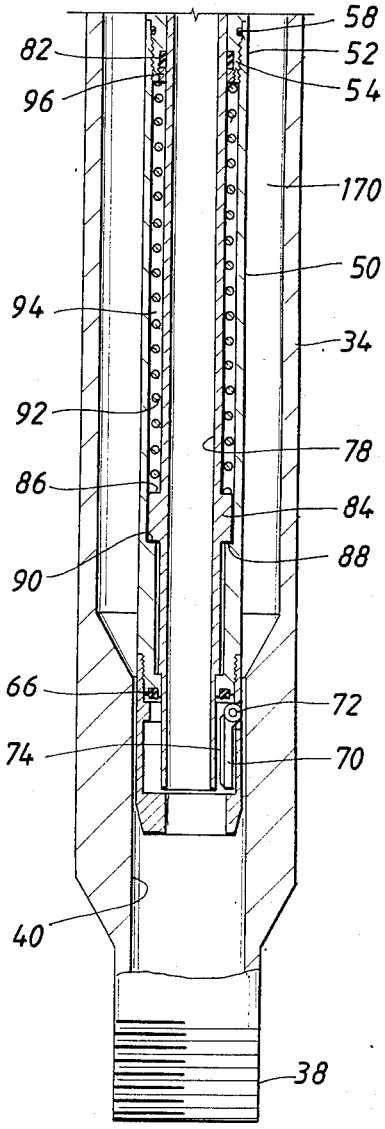
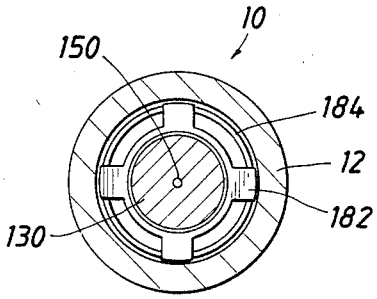
FIG. 2

FIG. 3A
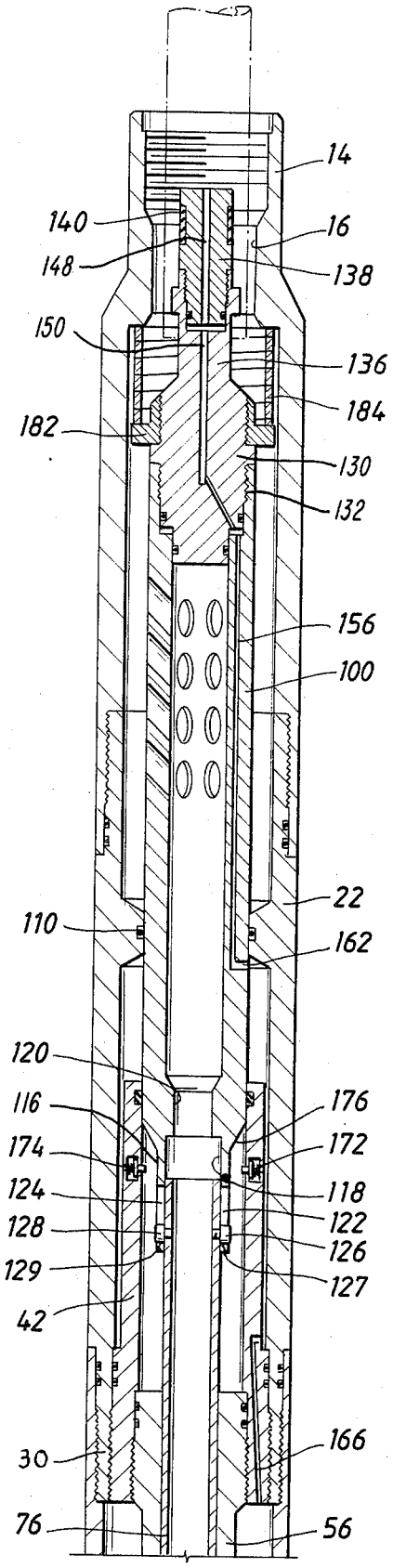
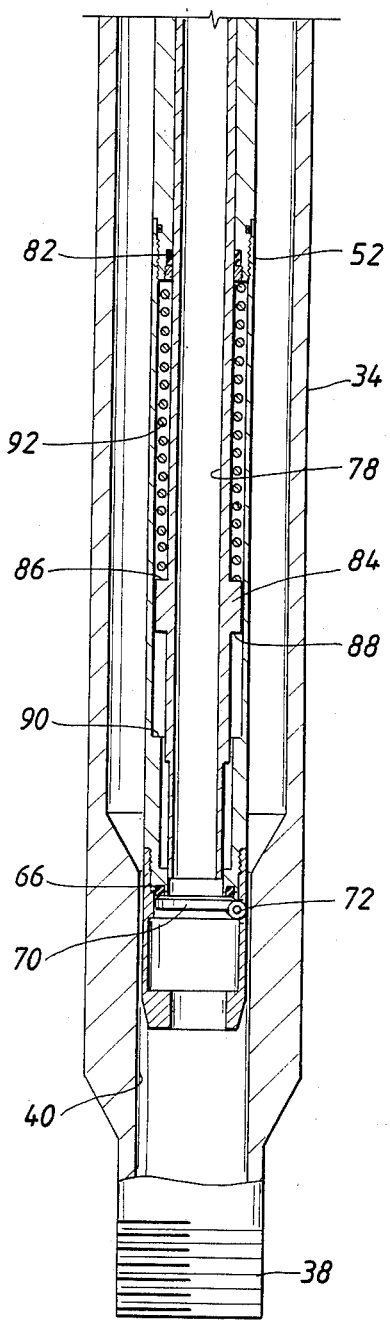
FIG. 3B

WIRE-LINE CONTROLLED DOWN-HOLE SHUT-IN TOOL FOR WELLS

FIELD OF THE INVENTION

This invention relates generally to down-hole equipment for controlling the flow of fluids in deep wells and, more particularly, is directed to apparatus for selectively controlling upward flow of fluid from an earth formation through a well bore, and for selectively shutting in the well such as for inspection of bottom hole pressure and accomplishing other well servicing activities.

BACKGROUND OF THE INVENTION

After a well has been drilled such as for production of petroleum products, a tubing string is inserted through the well bore established by the casing and is secured by means of a surface hanger assembly. The formation level of the well is isolated from the annulus between the tubing and casing by means of appropriate packer devices. It is frequently necessary to conduct inspection and servicing activities for protection of the well and for enhancing its production and service life. For example, inspection of formation pressure is necessary on a regular basis in order to determine the continuing status of the formation and thus permit maximized production from the well. It is impractical to check formation pressure at the surface and it is also risky to inspect formation pressure under flowing conditions. Formation pressure is typically inspected by postioning a pressure detection instrument in the tubing string near the formation level and temporarily shutting in the well to cease production activity while this temporary inspection is being conducted.

Obviously, when pressure measurement equipment is located in the flow passage of the well, it is subject to a pressure differential established by formation pressure and the tubing pressure above the pressure measuring instrument. When temporarily installed pressure measurement tools are employed it is possible for them to be ejected from the well by formation pressure and it is not usually possible to achieve max production flow with typical pressure measurement tools in place.

In every case when measuring bottom hole pressure, it is desirable to close off the tubing string above the pressure measurement recorder and as near to the formation level as possible. This will eliminate the storage effect, i.e., the effect of the formation filling the production string all the way to the surface and then effecting a maximum buildup of pressure. In some cases this process can take days or even weeks when formations are very tight. This is very costly when a rig is on location because of the per dium expense of the rig and the cost of labor. Until recently, a mechanical recorder would be used below a plug assembly which is positioned by wire-line equipment and which would be lowered into the well bore and locked into a nipple recess near the level of the formation. At some later point in time the plug and recorder would be retrieved by wireline methods. If for some reasons the recorder failed to work properly it is necessary to repeat the entire process. According to the present state of technology it is possible to record bottom hole pressure at the formation level by using an electronic instrument which records pressure and temperature and sends this information to a computer at the surface by way of electronic pulses traveling along a conductor wire-line. Because this instrument is connected to surface equipment by a wire-line it is not possible to set a plug above the equipment. Therefore, a plug must be set below the instrument and, a way must be devised to monitor the formation pressure below the plug by utilizing a bypass device that can be opened and closed by pulling or slackening the wire-line from the surface. The present invention effectively accomplishes these features.

SUMMARY OF THE INVENTION

It is a primary feature of the present invention to provide a novel down-hole formation pressure shut-in tool which is capable of accomplishing temporary shut-in of a well such as for pressure measurement activities.

It is also a feature of this invention to provide a novel down-hole shut-in tool for wells which is capable of being effeciently opened and closed by wire-line operated apparatus.

Briefly, the down-hole shut-in tool of this invention comprises an elongated mandrel structure adapted for connection to a production string within a well bore to become a permanent part of the production string. The mandrel or body structure defines an internal chamber adapted for registry with the flow passage of the production tubing.

A subsurface valve or shut-in valve in the form of a flapper type swing check valve or other suitable closure element is incorporated within the lower portion of the mandrel and is seated in its closed position against an internal valve seat to prevent upward flow through the flow passage of the mandrel. The flapper valve is maintained in its open position by means of an elongated flow tube assembly which is movably positioned within the internal chamber of the mandrel. The flow tube assembly defines a flow passage section and is normally urged downwardly to a valve open position by means of an external compression spring which is located on a lower flow tube assembly and is assisted by a second compression spring located externally of the upper ported flow tube extension of the flow tube assembly.

The flow tube assembly includes an elongated flow tube, which is positioned for reciprocation within the shut-in valve housing or mandrel. To the flow tube is connected a ported flow extension, the connection being in the form of a lost-motion connection permitting relative linear movement of the flow tube and flow tube extension. At its upper end, the flow tube extension includes a pressure transfer sub permitting transfer of formation pressure from the apparatus into a pressure gauge or other pressure measurement device in assembly therewith. The pressure transfer sub is provided with a fishing neck permitting interconnection of wire-line controlled apparatus therewith. Although this invention is discussed particularly in relation to operation by wire-line apparatus, such is not intended to limit the spirit and scope hereof. It is to be understood that operation of the shut-in tool may be controlled by equipment of any suitable character. The wire-line controlled apparatus includes pressure detection apparatus and other suitable instrumentation for detection of well conditions and for conducting other well servicing activities as desired. The wire-line controlled tool which attaches to the transfer sub is capable of being manipulated vertically to induce vertical movement to the flow tube extension, which movement, subject to relative movement permitted by the lost-motion connection, is induced to the flow tube. The flow tube is therefore operative responsive to linear movement of the flow tube extension for opening and closure of the swing check valve in the flow passage.

The lost-motion interconnection of the flow tube extension and flow tube is surrounded by a pressure equalizing sub forming a pressure transfer passage and including one or more pressure equalizing valves. The pressure equalizing valves are maintained in the normally opened positions thereof by the flow tube extension and are permitted to close after predetermined movement of the flow tube extension under the influence and control of the wire-line apparatus. The pressure equalizing valves normally maintain the mechanism in a pressure balanced position when the flapper valve is open and permit opening of the flapper valve under a substantially pressure balanced condition to minimize the force necessary to open the valve.

The flow tube extension, in addition to communicating formation pressure to the pressure transfer crossover mechanism for pressure measurement, also is operative, upon appropriate movement thereof, to open the pressure equalizing valves and thereby communicate formation pressure to the downstream side of the flapper-type swing check valve while the flapper valve is closed. This feature permits selective pressure balancing of the swing check valve, thereby permitting it to be opened without the presence of a pressure differential across the swing check valve. The flow tube assembly is thus enabled to open the subsurface safety valve with force of sufficient magnitude only for overcoming the small mechanical closing force of the flapper valve.

BRIEF DESCRIPTION OF THE DRAWINGS

So that the manner in which the above-recited features, advantages and objects of the present invention are attained and can be understood in detail, more particular description of the invention, briefly summarized above, may be had by reference to the embodiment thereof which is illustrated in the appended drawings, which drawings form a part of this specification. It is to be noted, however, that the appended drawings illustrate only a typical embodiment of this invention and are therefore not to be considered limiting of its scope, for the invention may admit to other equally effective embodiments.

In the Drawings:

The present invention, both as to its organization and manner of operation, together with further objects and advantages thereof, may best be understood by way of illustration when taken in conjunction with the accompanying drawings in which:

FIG. 1A is a sectional view of the upper portion of a down-hole shut-in tool constructed in accordance with the present invention which tool is positioned in the open or production flow condition thereof.

FIG. 1B is a sectional view of the lower portion of the down-hole shut-in tool illustrated in FIG. 1A.

FIG. 2 is a sectional view of the down-hole shut-in tool shown in FIGS. 1A and 1B, the section being along line 2—2 of FIG. 1A.

FIG. 3A is a sectional view similar to that of FIG. 1A and illustrating the internal components of the apparatus in the valve closed or shut-in position thereof.

FIG. 3B is a sectional view similar to that of FIG. 1B and illustrating the internal apparatus in the valve closed or shut-in position thereof.

DETAILED DESCRIPTION OF PREFERRED EMBODIMENT

Referring now to the drawings and first to FIGS. 1A and 1B, a down-hole shut-in tool is illustrated generally at 10, which is in the form of an elongated, generally cylindrical apparatus typically referred to as a body or housing structure and which is also referred to as a "mandrel." The mandrel or body 10 is provided with an upper body sub 12 having an upper, internally threaded box section 14 adapted for connection to an externally threaded pin portion of a tubing string, not shown. The upper body sub 12 defines an exit passage 16 which communicates with the flow passage of the tubing flow string and permits production flow from the mandrel to the tubing string.

The upper body sub 12 defines an internally threaded lower portion 18 which is adapted to receive an externally threaded upper portion 20 of an intermediate body sub 22. The upper body sub also forms an internal stop shoulder 24 which is engaged by the upper end surface 26 of the intermediate body sub for accurate alignment or relative positioning of the upper and intermediate body subs. Sealing members such as O-rings 28 are provided to establish a positive seal between the upper and intermediate body subs.

The lower extremity of the intermediate body sub is provided with an externally threaded portion 30 which is received by the internally threaded upper extremity 32 of a lower body sub 34. Sealing between the intermediate and lower body subs is achieved by circular sealing elements 36 which may conveniently take the form of O-rings or seals of any other suitable character. The lower end of the lower body sub is defined by an externally threaded pin connection 38 which is adapted to be received by the internally threaded box portion of a section of tubing string located below the shut-in tool mechanism. The lower body sub forms an internal flow passage 40 which is in registry with the flow passage of the section of tubing string located below the level of the shut-in valve.

Within the lower portion of the intermediate body sub 22 is provided a pressure equalizing sub 42 having an externally threaded lower portion 44 which is received by internal threads 46 within the lower portion of the intermediate body sub. Thus, the pressure equalizing sub 42 is restrained in immovable relation within the lower portion of the intermediate body sub and it is sealed with respect to the intermedaite body sub by circular sealing elements 48 such as O-rings or the like. The pressure equalizing sub, together with other structure, serves as a partition separating the internal chamber into a pressure chamber, which is always at formation pressure and a flow chamber which communicates with the production tubing downstream of the mandrel.

It is desirable that the down-hole shut-in apparatus be provided with a simple, efficient and reliable valve mechanism which is capable of being easily opened and closed. Although a number of different types of valve mechanisms have been provided over the years for service as subservice safety valves, swing check valves, typically known as flapper valves, have been found quite reliable. Accordingly, the present invention incorporates a flapper valve mechanism as an important component thereof. Flapper valves typically have the disadvantage of being difficult to open if a pressure differential of significant magnitude exists across a closed valve. In view of the significantly high pressures ordinarily encountered in some wells other more complex, more expensive and less reliable valves are frequently employed as subsurface safety valves.

Within the lower body sub 34 of the valve housing is provided a flow tube housing 50 having its internally threaded upper extremity 52 in assembly with the externally threaded lower extremity 54 of a housing support adapter 56. The flow tube housing is sealed with respect to the housing adapted 56 by means of a circular sealing element 58. The upper portion of the housing adapter 56 is in turn provided with an externally threaded portion 60 which is received by the internally threaded lower extremity 62 of the pressure equalizing sub 42. The housing adapter is sealed with respect to the equalizing sub by means of circular sealing elements 64 which may conveniently take the form of O-rings or any other suitable sealing elements. Thus, the housing adapter and flow tube housing cooperate with the pressure equalizing sub to form the sealed partition within the mandrel chamber.

To the lower extremity of the flow tube housing 50 is retained a circular valve seat 66 which may be composed of any suitable sealing material for the conditions of pressure and the fluid characteristics that may be encountered. A valve housing 68 is threadedly connected to the lower portion of the flow tube housing and provides support for a flapper valve 70 which is movably disposed therein. The flapper valve is supported by a pivot member 72 and is normally urged to its closed position in contact with the valve seat 66 by means of a torsion spring surrounding the pivot pin and reacting against the valve housing and the valve element. In absence of forces induced by pressure or induced mechanically, the flapper valve element 70 is rotated by its torsion spring to the closed position with the sealing face 74 thereof in sealing contact with the circular seat member 66.

Valve operation is controlled mechanically by a flow tube member 76 which is in the form of an elongated tubular element forming an internal passage 78 through which production fluid may pass as it flows upwardly through the tubing string and through the shut-in valve mechanism. The flow tube member extends through a passage 80 formed in the housing support adapter 56. The fit of the flow tube 76 within the elongated guide passage 80 is such that the flow tube is restricted from significant transverse movement as it moves linearly within the flow tube housing. A packing assembly 82 retained within the lower extremity of the housing support adapter 56 maintains a sealed relationship between the flow tube and the housing support adapter, thereby preventing leakage along the exterior of the flow tube.

Near its lower extremity the flow tube is provided with an annular enlargement 84 forming upper and lower stop shoulders 86 and 88. In its lower most, or valve open position, as shown in FIG. 1B, the lower stop shoulder 88 is disposed in contact with an annular internal stop shoulder 90 defined by the flow tube housing 50. Thus, as shown in FIG. 1B further downward movement of the flow tube is prevented by shoulder 90. The flow tube is urged downwardly to the open valve position shown in Fig. 1B by means of a compression spring 92 disposed within a spring chamber 94 being defined by an annulus between the flow tube and flow tube housing. The upper extremity of the compression spring 92 is restrained by a packing retainer element 96 which serves as a stop shoulder for the upper end of the compression spring. The lower portion of the compression spring is in contact with the annular stop shoulder 86 defined by the annular enlargement 84 of the flow tube. Compression spring 92, which is always under at least slight compression, reacts against the stop shoulder 86 and against the packing retainer element 96 and thus urges the flow tube downwardly.

Movably disposed within the upper and intermediate sub portions of the housing structure is provided a flow tube extension 100 which is also of tubular form but is of greater diameter as compared to the dimension of the upper portion of the flow tube. The flow tube extension defines an internal flow passage 102 which is in communication with an annulus 104 defined between the flow tube extension and the external housing structure of the shut-in valve apparatus by means of a plurality of ports 106 formed in the wall structure of the flow tube extension. The flow tube extension defines an external cylindrical sealing surface 108 which is engaged by a circular sealing member 110 to maintain a positive, fluid tight seal with respect to the outer housing structure. The intermediate body sub is provided with an internally extending flange portion 112 forming a cylindrical surface segment 114 disposed in close fitting relation with the external sealing surface 108 of the flow tube extension. The externally extending flange 112 is internally grooved to received a circular sealing element 110. The sealing element 110 may conveniently take the form of a rod tee seal which is of commercially available nature or any other suitable sealing assembly capable of withstanding significant pressure differential.

A lost-motion connection is established between the upper extremity of the flow tube member 76 and the lower extremity of the flow tube extension. As shown at the lower portion of FIG. 1A, the flow tube extension defines a reduced diameter tubular connecting portion 116 forming an internal receptacle 118 which receives the upper extremity of the flow tube in movable relation therein. The dimension of the flow tube receptacle 118 is such that the flow tube member is so received therein that its internal cylindrical surface defining the flow passage 78 is in substantial registry with an internal cylindrical surface 120 forming a portion of the flow passage 102 of the flow tube extension 100. The tubular connecting portion 116 of the flow tube extension defines opposed elongated slots 122 and 124 which receive respective locking screws 126 and 128 which are affixed to the upper end portion of the flow tube member. Thus, the flow tube member and flow tube extension are relatively movable within limits defined by the length of the opposed slots 122 and 124. These positions are shown in a comparison of FIG. 1A with FIG. 2A. This lost-motion connection enables effective closure of the flapper valve for efficient inspection of bottom hole pressure and also enables pressure balancing of the flapper valve prior to opening thereof. These features will be described in detail hereinbelow.

At the upper extremity of the ported flow tube extension 100, is provided a pressure transfer sub 130 having an externally threaded portion 132 which is received by the upper internally threaded extremity 134 of the flow tube extension. The pressure transfer sub defines an upwardly extending fishing neck 136 enabling connection thereto by a wire-line tool such as an overshot. A packing retainer 138 having a packing assembly 140 provided thereabout extends from the upper portion of the fishing neck, And is secured thereto by means of a threaded connection 142. The packing retainer is provided with an annular sealing element 144 which establishes a sealed relationship within a packing retainer pocket 146 defined within the upper extremity of the pressure transfer sub. The packing retainer and pressure transfer sub define respective passages 148 and 150 which are in fluid communication. An angulated portion 152 of the pressure transmitting passage intersects a circular stop shoulder 154 directed downwardly from the transfer sub. The passage segment 152 is in communication with a pressure transmitting passage 156 of the flow tube extension. Sealing elements 158 and 160 provide effective sealing between the transfer sub and the flow tube extension, thereby preventing any leakage from the pressure transmitting passage. Passage 156 terminates at a lateral port 162 which communicates the pressure transmitting passage with the annulus 164 between the flow tube extension and intermediate body sub below the level of the circular sealing element 110. Another pressure transmitting passage 166 formed in the lower portion of the pressure equalizing sub 42 is also communicated by a transverse port 168 with the annulus 164. The flow passage of the flow tube and flow tube extension, the annulus about the flow tube extension and about the pressure equalizing sub cooperate to define a "flow chamber" which in the closed or shut-in state of the apparatus is separated by the pressure equalizing partition from the pressure chamber 170.

In the value open position shown in FIGS. 1A and 1B, fluid pressure at the lower portion of the housing structure is communicated into the annulus or pressure chamber 170 defined between the lower body sub 34 and the flow tube housing 50. Thus formation pressure is communicated via passage 166, annulus 164, and passage segments 162, 156, 152, 150 and 148 with a pressure gauge or other pressure detection instrument carried by a wire-line tool in assembly with the fishing neck and packing adapter. Formation pressure is so communicated to pressure measuring equipment is both the open and shut-in conditions of the shut-in tool.

The equalizing sub 42 is provided with one or more normally open pressure equalizing valves such as shown at 172 and 174 which are maintained in their respective open positions by engagement with the external cylindrical surface 108 of the flow tube extension. Near the lower extremity of the flow tube extension is defined a tapered or frusto-conical surface 176 which functions as a cam surface for opening of the pressure equalizing valves 172 and 174. The tapered shoulder 176 also permits closure of the pressure equalizing valves as the flow tube extension is moved upwardly sufficiently to cause the cylindrical surface 108 to move past the equalizing valves. The tapered cam surface 176 provides relief for the valves 172 and 174, permitting their automatic closure by spring force as the tapered cam surface is positioned adjacent the pressure equalizing valves.

The wire-line activated down-hole tool of this invention is normally disposed in the open position shown in FIGS. 1A and 1B with the flapper valve 70 maintained in its open position by the lower valve operating extremity of the flow tube 76.

The pressure transfer sub 130 defines an annular flange 178 which forms a circular stop shoulder 180 providing a support for a spring retainer nut 182, best shown in FIG. 2. The spring retainer nut is engaged by the lower end of a helical compression spring 184 which surrounds the upper portion of the fishing neck 136. The upper end of the upper compression spring is restrained by an internal stop shoulder 186 formed within the upper body sub 12. The upper compression spring normally urges the flow tube extension 100 downwardly, causing its lower extremity 188 to engage the upwardly directed stop shoulder 190 defined by the upper end of the housing adapter 56. The upper compression spring 184 therefore aids the lower compression spring 92 in urging the flow tube 76 toward the valve open position thereof as shown in FIGS. 1A and 1B.

In the normal, valve open condition of the shut-in tool, well fluids from the tubing string section below the shutin tool enter the internal passage of the housing structure and flow upwardly through the central flow passage 78 of the flow tube. The flowing fluid then passes from the flow tube into the central flow passage 102 of the flow tube extension and then radially outwardly through the lateral ports 106 of the flow tube extension and into the annulus 104. The upwardly flowing fluid then flows through the openings of the spring retainer nut 182 and continue upwardly flow past the compression spring and through passage 116 into the passage of the tubing string above the tool.

It should be noted that well can pass around the outer diameter of the flow tube 76 and into the annulus 170 between the lower body sub 34 and the flow tube housing 50.

Well pressure passes through the manufacturing clearances between the flow tube and flow tube extension since seals are not present in the region of the lost-motion connection. This pressure then enters the passage 166 of the equalizing sub 42 and passes into the annulus 164 between the flow tube extension and the intermediate body sub 22. From the annulus 164 the pressure then flows through the normally open pressure equalizing valves 172 back into the flow tube 76 via the annulus between the equalizing sub and the ported flow tube extension 100 and back to the formation.

In the open condition of the shut-in tool, the flapper valve 70 is maintained in its open position by the flow tube under the influence of the flow tube operating spring 92. The activity of spring 92 is assisted by the force of the upper compression spring 184. Both of the springs 92 and 184 are maintained under slight compression in the normally open position of the valve apparatus and are further compressed as the mechanism is shifted to the shut-in position.

To achieve valve closure for shutting in the well temporarily to permit a formation test to be conducted, a special overshot device (not shown) is caused to attach to the fishing neck 136 and through wire-line activation the overshot tool applies an upwardly directed force to the flow tube extension 100. As this upwardly directed force is applied, the flow tube extension 100 is moved upwardly against the compression of spring member 184, this upward movement continuing until stop shoulders 127 and 129 at the lower ends of the opposed slots 122 and 124 engage the locking screws 126 and 128. At this point, through the lost-motion connection between the flow tube extension 100 and flow tube 76, upwardly directed force from the flow tube extension is transmitted to the flow tube initiating further compression of the lower spring 92. As the upwardly directed force is increased on the fishing neck 136, the flow tube spring 92 becomes compressed until the lower valve operating extremity of the flow tube is retracted upwardly past the valve seat 66. At this point the flapper valve spring causes the flapper valve to rotate to its seated relationship with the flapper valve seat.

Prior to closure of the flapper valve, the ported flow tube extension 100 is moved upwardly until its frustoconical shoulder 176 is moved upwardly past the pressure equalizing valves 172 and 174, allowing the pressure equalizing valves to close. Closure of the pressure equalizing valves terminates communication between the formation and the internal production flow passage of the flow tube via passage 166. The force induced by formation pressure across the closed flapper valve maintains the flapper valve in its closed position. When the flapper valve is closed the only path for well fluids is through the annulus between the flow tube housing 50 and the lower body sub 34, through passage 166 and the ported flow tube extension 100 which is isolated by the rod tee seal 110. Formation pressure is transferred through passage segments 162, 156, 152, 150 and 148 to a pressure gauge or other pressure measuring apparatus in communication with passage segment 148.

Subsequent to completion of pressure testing of the well, to achieve valve opening, the wire-line controlled apparatus is caused to release its tension force on the fishing neck 136. When the tension force is so released, the combined forces of compression springs 92 and 184 urge the flow tube extension 100 and the flow tube 76 downwardly. Additional downward movement of the flow tube extension causes the tapered cam surface 176 to engage the pressure equalizing valve 172 and 174. As downward movement of the flow tube extension continues, the tapered shoulder 176 forces the equalizing valves to the open position, thereby admitting pressure of the formation into the flow tube and thereby establishing a substantially pressure balanced condition across the flapper valve 70. Continued downward movement of the flow tube extension and flow tube occurs, causing the lower extremity of the flow tube to engage the flapper valve 70 and urge it to its open condition. After this has been accomplished, the shut-in tool is again rendered to its open production flow condition, thereby permitting upward flow of production fluid through the flow tube and ported flow tube extension to the tubing string above the shut-in tool. Since the mechanism is operative to achieve opening of the flapper valve in its pressure balanced condition, the valve opening mechanism may be of relatively light weight and low cost construction with detracting from the effective service life thereof.

It is therefore seen that the present invention is one well adapted to attain all of the objects and features hereinabove set forth together with other features which are inherent from the apparatus illustrated and described herein. It is not intended that the specific apparatus disclosed be limiting in regard to the present invention, but that other and various forms of the invention are possible within the spirit and the scope hereof.

I claim:

1. A wire-line controlled down-hole shut-in tool for wells, comprising:

(a) a mandrel adapted to form a part of a tubing string installed in a well bore and forming an elongated internal chamber;

(b) a shut-in valve mechanism being located within said mandrel and having a valve seat, a shut-in valve element supported for movement to open and closed positions relative to said valve seat and means urging said shut-in valve element toward the closed position thereof;

(c) elongated flow tube means being movably disposed within said elongated internal chamber and forming a flow passage being part of production flow passage means through said mandrel, said elongated flow tube means defining upper and lower flow tube sections each being movably disposed within said elongated internal chamber, said lower flow tube section forming a valve control portion of said flow tube means normally restraining said shut-in valve element in the open position permitting production flow through said production flow passage means, a lost-motion connection securing said upper and lower flow tube sections in relatively movable assembly, said elongated flow tube means being linearly movable in one direction within said mandrel to a shut-in position retracting said valve control portion thereof from its restraining relation with said shut-in valve element and permitting closing movement of said shut-in valve element for shutting-in the well;

(d) pressure transfer passage means communicating well pressure upstream of said shut-in valve element past the closed shut-in valve element, through said mandrel to pressure detection apparatus;

(e) means responsive to linear movement of upper flow tube section of said elongated flow tube means in the opposite direction for pressure balancing said shut-in valve element in the closed position thereof; and (f) after substantial pressure balancing of said valve element said valve control portion of said elongated flow tube means imparting opening movement to said shut-in valve element as said elongated flow tube means completes its linear movement in said opposite direction.

2. A wire-line controlled down-hole shut-in tool as recited in claim 1, wherein:

spring means urges said elongated flow tube means toward said other position.

3. A wire-line controlled down-hole shut-in tool as recited in claim 2, wherein said spring means comprises:

(a) an upper compression spring, reacting within said mandrel and applying downwardly directed force to said upper flow tube section; and (b) a lower compression spring reacting within said mandrel and applying downwardly directed force to said lower flow tube section.

4. A wire-line controlled down-hole shut-in tool as recited in claim 1 including:

(a) flow tube housing means being fixed within said elongated internal chamber and forming an internal flow tube passage;

(b) a valve housing being supported by said flow tube housing means;

(c) said elongated flow tube means extending into said flow tube housing means; and (d) said valve control portion of said lower flow tube section extending into said valve housing and restraining said valve element in the open position thereof, said valve control portion being movable to a retracted position within said valve housing to permit closing of said valve element.

5. A wire-line controlled down-hole shut-in tool as recited in claim 4, wherein:

said flow tube housing means and said flow tube cooperatively form a partition separating said internal chamber into a pressure section and a flow section, said pressure section being at well pressure in the open and closed positions of said valve element, said flow section being at well pressure only in the open position of said valve element.

6. A wire-line controlled down-hole shut-in tool as recited in claim 6, including:

pressure transfer passage means being defined in part by said flow tube means and being in communication with said pressure section for continuous transmission of well pressure to said pressure detection means in said open and closed positions of said valve element.

7. A wire-line controlled down-hole shut-in tool as recited in claim 1, wherein said pressure balancing means comprises:

(a) a pressure equalization sub being fixed within said mandrel;

(b) pressure equalization valve means being supported by said pressure equalization sub; and (c) said elongated flow tube means maintaining said pressure equalization valve means open in said other position of said elongated flow tube means and permitting closure of said pressure equalization valve means at said one position of said elongated flow tube means.

8. A wire-line controlled down-hole shut-in tool as recited in claim 1, wherein:

(a) said lower flow tube section defines a portion of a production flow passage therein and has valve controlling relation with said shut-in valve mechanism; and (b) said upper flow tube section defines a portion of said production flow passage and has valve controlling relation with said pressure equalization valve means.

9. A wire-line controlled down-hole shut-in tool as recited in claim 8, including:

(a) connecting portions of said flow tube member and said flow tube extension having telescoping relation;

(b) guide slot means being defined by one of said connecting portions; and (c) locking means being secured to the other of said connecting portions and being received within said guide slot means, said locking means and said guide slot means cooperatively defining said lost-motion connection, said locking means restraining telescoping movement of said connecting sections within limits defined by the length of said guide slot means.

10. A wire-line controlled down-hole shut-in tool as recited in claim 9, wherein:

said flow tube extension defines cam surface means having camming valve opening engagement with said equalization valve means during movement of said flow tube extension in said other direction.

11. A wire-line controlled down-hole shut-in tool as recited in claim 8 wherein:

(a) said pressure equalization sub is of generally tubular form and is secured in sealed relation to said mandrel;

(b) said upper and lower flow tube sections extend into said pressure equalization sub and are sealed relative thereto such that said pressure equalization sub forms a partition separating said elongated internal chamber into a pressure section and a flow section; and (c) said pressure equalization valve means in the open position thereof establishing communication between said pressure section and flow section.

12. A wire-line controlled down-hole shut-in tool as recited in claim 11, including:

(a) flow tube housing means being supported by said pressure equalization sub in fixed relation within said elongated internal chamber;

(b) a valve housing being supported by said flow tube housing means and containing said shut-in valve mechanism;

(c) said lower flow tube section of said elongated flow tube means extending into said flow tube housing; and (d) said valve control portion of said lower flow tube section extending into said valve housing and restraining said shut-in valve element in the open position thereof, said valve control portion being substantially retracted from said valve housing to permit closing of said shut-in valve element.

13. A wire-line controlled down-hole shut-in tool as recited in claim 12, wherein:

(a) said flow tube member and flow tube housing means cooperatively define a spring chamber; and (b) a compression spring being located within said spring chamber and urging said flow tube toward the valve opening position thereof.

14. A wire-line controlled down-hole shut-in tool as recited in claim 12, wherein:

(a) said flow tube extension defines pressure transfer passage means for communication with pressure measuring apparatus; and (b) said pressure equalization sub defines passage means communicating well pressure with said pressure transfer passage means.

15. A down-hole shut-in tool for wells, comprising:

(a) a mandrel adapted to form a part of a tubing string installed in a well bore and forming an internal chamber;

(b) a shut-in valve mechanism being located within said mandrel and having a valve seat, a shut-in valve element supported for movement to open and closed positions relative to said valve seat;

(c) elongated flow tube means being linearly movable within said internal chamber and forming production flow passage means, said elongated flow tube means defining upper and lower flow tube sections, said lower flow tube section having a valve control portion normally restraining said shut-in valve element in the open position permitting production flow through said production flow passage, said flow tube means being linearly movable in one direction within said mandrel to a shut-in position retracting said valve control portion of said lower flow tube section from its restraining relation with said shut-in valve element and permitting closing movement of said shut-in valve element for shutting-in the well, said elongated flow tube means also defining an upper flow tube section having a lost-motion connection with said lower flow tube section to permit limited relative linear movement therebetween;

(d) pressure transfer passage means communicating well pressure upstream of said valve element past the closed shut-in valve element, through said mandrel to pressure detection apparatus;

(e) means responsive to linear movement of said upper flow tube section of said elongated flow tube means in the opposite direction for substantially pressure balancing said valve element in the closed position thereof; and (f) after substantial pressure balancing of said shut-in valve element said valve control portion of said lower flow tube section imparting opening movement to said shut-in valve element as said elongated flow tube means completes its linear movement in said opposite direction.

16. A down-hole shut-in tool for wells, comprising:

(a) a mandrel adapted to form a part of a tubing string installed in a well bore and forming an internal chamber;

(b) partition means separating said internal chamber into a pressure chamber in communication with well pressure and a flow chamber;

(c) a shut-in valve mechanism being located within said mandrel and having a valve seat, a shut-in valve element supported for movement to open and closed positions relative to said valve seat;

(d) elongated flow tube means being movably disposed within said internal chamber and forming production flow passage means, said flow tube means defining a valve control portion normally restraining said shut-in valve element in the open position permitting production flow through said production flow passage means, said elongated flow tube means being linearly movable in one direction within said mandrel to a shut-in position retracting said valve control portion of said lower tube section from its restraining relation with said shut-in valve element and permitting closing movement of said shut-in valve element for shutting-in the well, said flow tube means comprising:

(1) a flow tube member defining a portion of a production flow passage therein and having valve controlling relation with said shut-in valve mechanism, said flow tube member defining said valve control portion;

(2) a flow tube extension defining a portion of said production flow passage; and (3) a lost-motion connection securing said flow tube and said flow tube extension in assembly such that relative linear movement in permitted therebetween.

(e) pressure transfer passage means communicating well pressure upstream of said shut-in valve element past the closed shut-in valve element, through said mandrel to pressure detection apparatus;

(f) pressure equalizing valve means responsive to linear movement of said flow tube extension in the opposite direction for communicating said pressure chamber and said flow chamber and substantially pressure balancing said shut-in valve element in the closed position thereof, said flow tube extension having valve controlling with said pressure equalizing valve means; and (g) after pressure balancing of said shut-in valve element said valve control portion of said flow tube member imparting opening movement to said shut-in valve element as said flow tube member completes its linear movement in said opposite direction.

17. A down-hole shut-in tool as recited in claim 16, wherein:

a plurality of ports are formed in said flow tube extension and communicate said production flow passage with the tubing string downstream of said mandrel.

* * * * *